US010180660B2

(12) United States Patent
Hosobuchi et al.

(10) Patent No.: US 10,180,660 B2
(45) Date of Patent: Jan. 15, 2019

(54) ELECTRONIC TIMEPIECE

(71) Applicant: CASIO COMPUTER CO., LTD., Tokyo (JP)

(72) Inventors: Hiroyuki Hosobuchi, Iruma (JP); Junro Yano, Hachioji (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 149 days.

(21) Appl. No.: 15/252,723

(22) Filed: Aug. 31, 2016

(65) Prior Publication Data

US 2017/0068220 A1 Mar. 9, 2017

(30) Foreign Application Priority Data

Sep. 7, 2015 (JP) ..... 2015-175603

(51) Int. Cl.
*G04B 43/00* (2006.01)
*G04R 60/00* (2013.01)

(52) U.S. Cl.
CPC ..... *G04B 43/00* (2013.01); *G04R 60/00* (2013.01)

(58) Field of Classification Search
CPC ..... G04C 3/14; G04G 17/00; G04G 17/02; G04G 17/04; G04R 60/00; G04R 60/02; G04R 60/04; G04R 60/06; G04R 60/10; G04R 60/12; H01Q 1/273
See application file for complete search history.

(56) References Cited

U.S. PATENT DOCUMENTS 1,871,345 A * 8/1932 Rigante ..... H01F 27/36 336/171
4,033,111 A * 7/1977 Matsuura ..... G04B 43/00 310/256
4,117,665 A * 10/1978 Nakao ..... G04B 29/04 368/293
4,317,188 A * 2/1982 Ushikoshi ..... G04B 43/00 310/256
4,496,246 A * 1/1985 Ota ..... G04B 19/25 368/220
4,897,825 A * 1/1990 Ikenishi ..... G04B 19/02 368/228
6,124,774 A * 9/2000 Quelo ..... G01D 1/16 310/152
8,040,287 B2 * 10/2011 Kimura ..... G04C 3/146 343/702
8,072,844 B2 * 12/2011 Miyahara ..... G04G 21/04 343/788

(Continued)

FOREIGN PATENT DOCUMENTS

JP 2014-062852 A 4/2014

*Primary Examiner* — Edwin A. Leon
(74) *Attorney, Agent, or Firm* — Scully, Scott, Murphy & Presser, P.C.

(57) ABSTRACT

In a timepiece 100 having an antenna 3 and motors 4, each motor 4 includes a stator 41, a coil 42 magnetically connected to the stator 41, and a rotor magnet 431 disposed in a receiving part 411 of the stator 41. With respect to each motor 4 disposed in a predetermined range from the antenna 3, an individual antimagnetic plate 5 which is a belt-like antimagnetic plate configured to have a width equal to or greater than the diameter of the rotor magnet 431 and cover a portion of the motor 4 including the rotor magnet 431 is disposed.

16 Claims, 9 Drawing Sheets

(56) References Cited

U.S. PATENT DOCUMENTS

| | | | | |
|---|---|---|---|---|
| 2008/0080320 | A1* | 4/2008 | Abe | G04C 3/14<br>368/47 |
| 2010/0097895 | A1* | 4/2010 | Sumida | H01Q 1/273<br>368/28 |
| 2012/0201101 | A1* | 8/2012 | Akiyama | G04R 20/06<br>368/47 |
| 2014/0085154 | A1* | 3/2014 | Nagahama | G04R 60/10<br>343/720 |
| 2014/0086026 | A1* | 3/2014 | Mitani | G04R 60/12<br>368/278 |

* cited by examiner

ELECTRONIC TIMEPIECE

CROSS-REFERENCE TO RELATED APPLICATION

This application is based upon and claims the benefit of priority from the prior Japanese Patent Application No. 2015-175603, filed on Sep. 7, 2015, and the entire contents of which are incorporated herein by reference.

BACKGROUND OF THE INVENTION

The present invention relates to an electronic timepiece.

In the related art, there are known electronic timepieces, each of which has a plurality of motors such as stepping motors, and an antenna for receiving a standard radio wave which is a long radio wave, and performs various operations, such as time correction based on the standard radio wave.

If the operation accuracy of the motors is regarded as important, it is preferable to dispose antimagnetic plates for magnetically shielding the motors from external magnetic fields which may exert influence on the operations of the motors.

However, the antimagnetic plates are made of a material having high relative-permeability, and if such members having high relative-permeability are disposed near the antenna, it becomes easier for eddy current to occur, and loss of electric energy (eddy-current loss) occurs, whereby the receiving sensitivity of the antenna decreases.

For this reason, for example, in Japanese Patent Application Laid-Open No. 2014-062852, it is proposed a technology in which antimagnetic plates for magnetically shielding motors from external magnetic fields are provided and an antenna is disposed so as not to overlap the antimagnetic plates.

However, in a case where an electronic timepiece is a small instrument such as a wristwatch, since every module should be assembled in a limited space of the inside of a case, inevitably, motors and an antenna are disposed close to one another.

In this regard, in the technology disclosed in Japanese Patent Application Laid-Open No. 2014-062852, the antimagnetic plates are formed in different shapes such that the antimagnetic plates do not overlap the antenna while covering the motors.

However, significant manufacturing cost is required in making the antimagnetic plates in different shapes, and the shapes of the antimagnetic plates should be changed depending on the assembly position of the antenna. Therefore, there is a problem that it is impossible to commoditize the antimagnetic plates.

Further, according to the layout of the motors and the antenna, even though the antimagnetic plates have different shapes, it may be difficult to provide sufficient distances between each antimagnetic plate and the antenna, and it may be apprehended that the receiving sensitivity of the antenna will decrease.

In an electronic timepiece which performs time correction on the basis of a standard radio wave, a decrease in the receiving sensitivity of an antenna causes the intrinsic timepiece performance to deteriorate.

For this reason, in electronic timepieces, the antimagnetic properties of motors have been sacrificed to some extent in order to secure the radio-wave reception performance of antennae.

SUMMARY OF THE INVENTION

An object of the present invention is to provide an electronic timepiece capable of securing the radio-wave reception performance of an antenna while securing the operation accuracy of motors.

An electronic timepiece according to the present invention comprises:

an antenna;

a motor including a stator, a coil magnetically connected to the stator, and a rotor magnet disposed in a receiving part of the stator; and a belt-like antimagnetic plate configured to have a width equal to or greater than a diameter of the rotor magnet and to cover a portion of the motor including the rotor magnet

DETAILED DESCRIPTION

Figure 1:
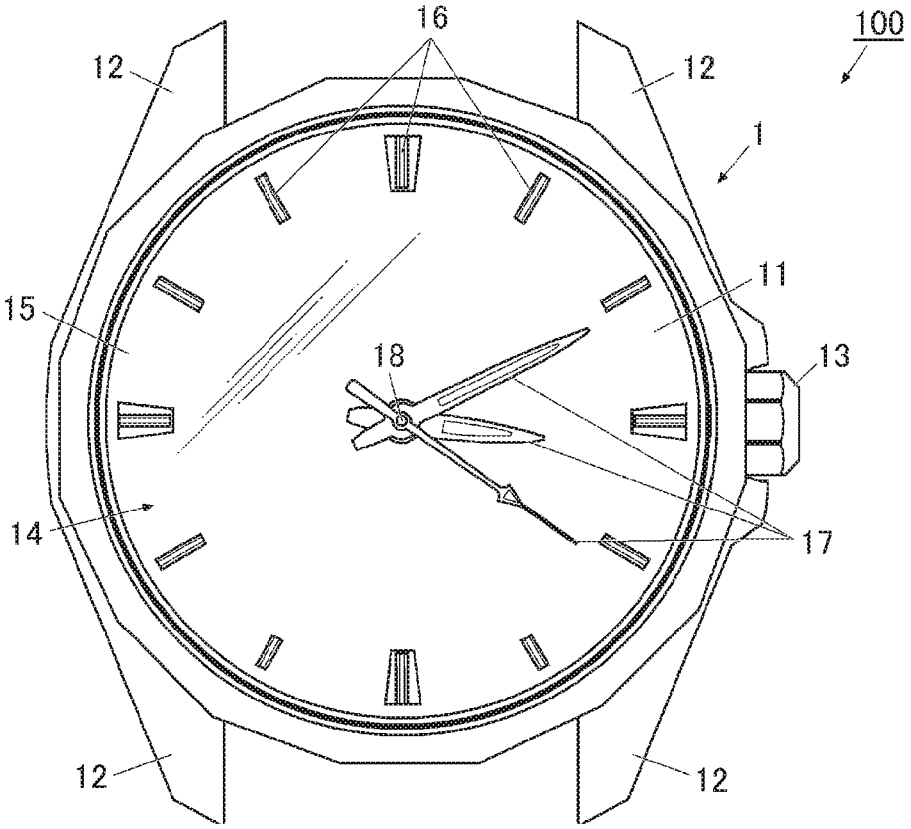
FIG. 1 is a front view illustrating an electronic timepiece according to an embodiment.

Hereinafter, preferred embodiments of an electronic timepiece according to the present invention will be described with reference to the accompanying drawings.

Although technically preferable various limitations are added to the embodiments to be described below in order to embody the present invention, the scope of the invention is not limited to the following embodiments and examples shown in the drawings.

[First Embodiment]

First, with reference to FIGS. 1 to 7, a first embodiment of an electronic timepiece according to the present invention will be described. Hereinafter, an electronic timepiece will be referred to simply as a "timepiece".

FIG. 1 is a plan view illustrating a timepiece (an electronic timepiece) according to the present invention.

As shown in FIG. 1, a timepiece 100 according to the present embodiment has a case (referred to as "timepiece case 1" in the following embodiments). The timepiece case 1 is made of, for example, a metal such as stainless steel or titanium, ceramic, or various synthetic resins. However, a material for making the timepiece case 1 is not limited to those examples.

The timepiece case 1 of the present embodiment is formed in a short column shape having a hollow, and on the front side of the timepiece 100 (the viewable side of the timepiece), a windshield member 11 made of transparent glass or the like is attached.

Also, on the back side of the timepiece 100, a back lid (not shown) is attached.

Both end portions of the timepiece case 1 in the upward and downward direction of FIG. 1, that is, an end portion of the analog type timepiece in the direction of 12 o'clock and an end portion of the analog type timepiece in the direction of 6 o'clock have band attachment portions 12 to which timepiece bands (not shown) are attached.

Also, the timepiece 100 has an operation button 13 on a side portion or the like of the timepiece case 1.

The inserted end portion of the operation button 13 is connected to a module (not shown) stored inside the timepiece case 1. Also, the operation button 13 is configured such that a user can perform various operations by pressing or rotating the operation button 13.

In the space between the timepiece case 1 and the windshield member 11, a display unit 14 is provided.

The display unit 14 of the present embodiment is an analog type display unit having a dial 15, and hands 17 such as a time hand, a minute hand, and a second hand disposed above the dial 15 as shown in FIG. 1.

On the circumferential portion of the front side of the dial 15, hour markers 16 are disposed as indicators of time to be shown by the hands 17.

However, the configuration and the like of the display unit 14 are not limited to the example shown in FIG. 1, and any other element such as a small display unit having a function hand may be further provided in the display unit. Also, the display unit 14 may be a digital type display unit having a liquid crystal panel or the like, or may include both of an analog type display unit having hands and a digital type display unit having a liquid crystal panel or the like.

Inside the timepiece case 1, for example, a module (not shown) including a timepiece movement (not shown) which is composed of gear train mechanisms and motors 4 (see FIG. 2) for moving the hands 17, an antenna 3 (see FIG. 2), a circuit board 23 (see FIGS. 3B and 3C) having various electronic components mounted thereon, and a battery (not shown) for supplying electric power to individual function units of the timepiece 100 is stored. Further, a hand spindle 18 passes through an approximately central portion of the dial 15 from the module side, and protrudes from the dial 15.

The hand spindle 18 of the present embodiment is a spindle in which a plurality of rotating shafts for the hour hand, the minute hand, the second hand, and the like are arranged so as to overlap on the same axis, and the hands 17 (for example, the hour hand, the minute hand, and the second hand) are connected to the rotating shafts of the hand spindle 18, respectively.

If the hand spindle 18 rotates according to an operation of the timepiece movement, the various hands 17 fit on the individual rotating shafts of the hand spindle 18 individually rotate around the hand spindle 18 over the front surface of the dial 15.

However, the number and the like of hands 17 which are attached to the hand spindle 18 and are movable around the hand spindle 18 are not limited to the example shown the drawings. For example, only one hand 17 may be provided, or a function hand for performing display related to various functions may be provided as a hand 17 in addition to the hour hand, the minute hand, and the second hand. Also, besides the hand spindle 18 for supporting the hands such as the hour hand, a hand spindle for supporting the function hand may be separately provided.

Figure 2:
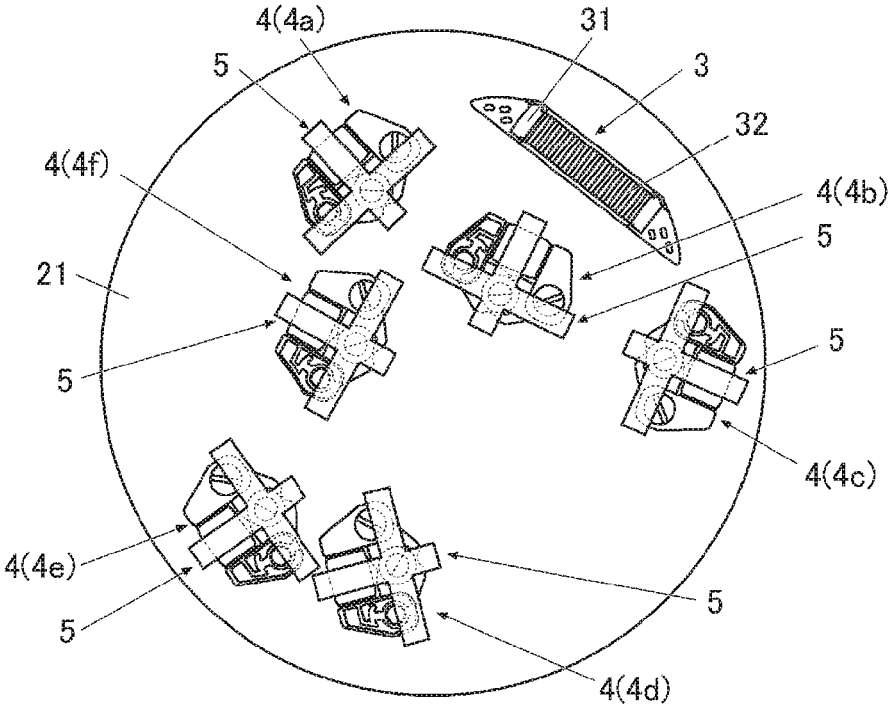
FIG. 2 is a plan view illustrating an antenna and motors disposed on a main plate according to a first embodiment.

FIG. 2 is a plan view illustrating the antenna and motors disposed on a main plate.

In the present embodiment, as shown in FIG. 2, the antenna 3 and a plurality of motors 4 (in the present embodiment, six motors 4*a* to 4*f*) are provided on a main plate 21, which is assembled in the module.

However, the number, arrangement, and the like of the antenna 3 and the motors 4 shown in FIG. 2 are illustrative, and do not limit the present invention.

The antenna 3 of the present embodiment is for receiving a standard radio wave including time information.

The antenna 3 has a core 3 made of, for example, a magnetic material such as an amorphous metal or ferrite, and a coil 32 wound around the core.

The timepiece 100 performs various operations, such as time correction based on a standard radio wave received by the antenna 3.

The motors 4 are for operating operation units. In the present embodiment, six motors 4 (that is, the motors 4*a* to 4*f*) are provided.

In the present embodiment, three hands 17 (that is, the second hand, the minute hand, and the hour hand) are shown as operation units in the drawings. However, operation units which are provided in the timepiece 100 are not limited thereto. More operation units may be provided.

Figure 3C:
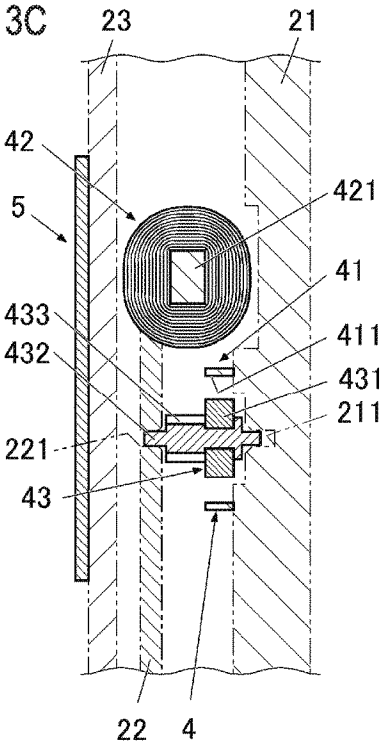
FIG. 3C is a cross-sectional view of a main portion along a line c-c of FIG. 3A.
Figure 3A:
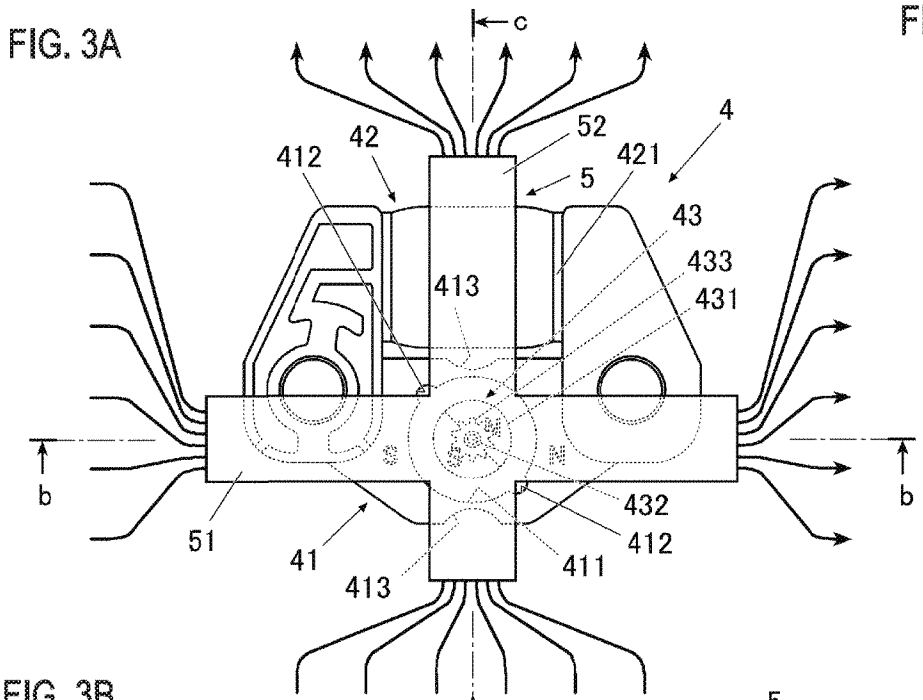
FIG. 3A is a plan view illustrating the motors and individual antimagnetic plates according to the first embodiment.
Figure 3B:
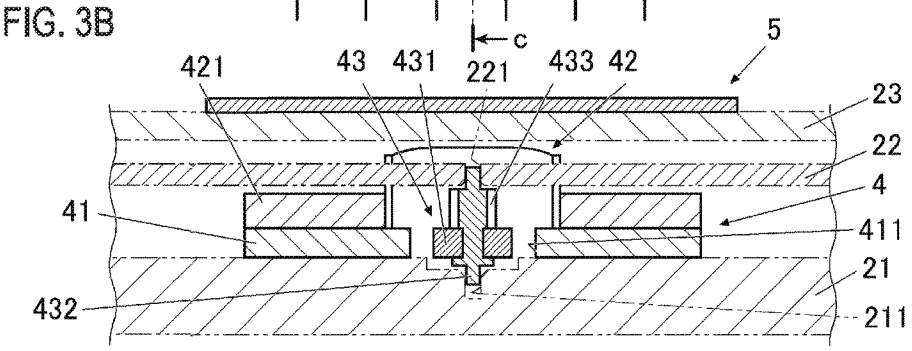
FIG. 3B is a cross-sectional view of a main portion along a line b-b of FIG. 3A.

FIG. 3A is a plan view illustrating a motor according to the present embodiment, and FIG. 3B is a cross-sectional view of a main portion along a line b-b of FIG. 3A, and FIG. 3C is a cross-sectional view of a main portion along a line c-c of FIG. 3A.

In FIGS. 3B and 3C, members which are not shown in FIG. 3A are shown by alternate long and two short dashes lines.

As shown in FIGS. 3A to 3C, a motor 4 (each of the motors 4*a* to 4*f*) has a stator 41, a coil 42 magnetically connected to the stator 41, and a rotor 43 disposed in a receiving part 411 of the stator 41.

The motor 4 (each of the motors 4*a* to 4*f*) is a stepping motor having a rotor 43 which rotates by a predetermined step angle if an appropriate drive pulse is applied to a coil 42 magnetically connected to a stator 41.

The stator 41 is a plate-like member configured to extend in the longitudinal direction of the motor 4 (the transverse direction in FIGS. 3A and 3B).

The stator 41 is mad of a high permeability material such as permalloy. However, a material for making the stator 41 is not limited to permalloy.

As shown in FIG. 3A, the stator 41 has the receiving part 411 for receiving the rotor 43.

The receiving part 411 is a substantially circular hole. In the present embodiment, the receiving part is disposed at an approximately central portion in the longitudinal direction of the stator 41 (in the present embodiment, this direction is the transverse direction of FIGS. 3A and 3B and is the longitudinal direction of the motor 4).

Also, on the inner surface of the receiving part 411, two inner recesses (inner notches) 412 are formed at positions substantially facing each other.

The inner recesses 412 constitute positioning parts for determining a position (a stable stop position) for the rotor 43 to stably stop.

A rotor magnet 431 of the rotor 43 has a tendency to stick to a closer metal. For this reason, when two poles of the rotor magnet 431 face parts other than the inner recesses 412, that is, the polarization position of the rotor magnet 431 of the rotor 43 faces two inner recesses 412, the holding torque of the motor 4 is maximized. Therefore, in a power cutoff state where any drive pulse is not applied to the coil 42 to be described below, the rotor 43 magnetically stably stops such that the polarization position of the rotor magnet 431 faces the inner recesses 412 as shown in FIG. 3A.

Also, the inner recesses 412 are disposed such that a line connecting the deepest parts of the inner recesses 412 and passing through the center of the circle shape of the receiving part 411 forms a certain angle with a line extending in the longitudinal direction of the stator 41 through the center of the circle shape of the receiving part 411.

The certain angle slightly varies depending on various conditions such as the specification of the motor 4, and it is preferable to appropriately set the certain angle between 30° to 50°. In the present embodiment, the certain angle is set to 45° (see FIG. 4B).

Also, on the outer surface of the stator 41, a pair of outer recesses (outer notches) 413 are formed so as to substantially face each other with the receiving part 411 interposed therebetween.

The outer recesses 413 are for determining a magnetic flux saturation part of the stator 41.

Parts of the stator 41 which are positioned between the outer recesses 413 and the receiving part 411 have narrow widths, and thus become saturable parts in which magnetic flux saturation can easily occur as compared to the other part.

Each saturable part is configured such that it is not magnetically saturated by magnetic fluxes of the rotor 43, and when the coil 42 (to be described below) is excited, the saturable part is magnetically saturated, thereby becoming a magnetic flux saturation part having high magneto-resistance.

However, the shapes, sizes, arrangements, and the like of the inner recesses (inner notches) 412 and the outer recesses (outer notches) 413 are not limited to the examples shown in the drawings.

The coil 42 is formed by winding wire around a portion of an elongated coil core 421.

The coil core 421 is made of a high permeability material such as permalloy.

Both end portions of the coil core 421 in the longitudinal direction are magnetically joined with both end portions of the stator 41 in the longitudinal direction, respectively, whereby the coil 42 is magnetically connected to the stator 41.

The motor 4 is fixed on the main plate 21, for example, by superimposing both end portions of the coil core 421 in the longitudinal direction and both end portions of the stator 41 in the longitudinal direction and screwing them to the main plate 21.

As shown in FIG. 3A, in the present embodiment, the rotor 43 has the discoid or cylindrical rotor magnet 431 formed so as to have a circular shape as seen in a top view.

The rotor magnet 431 is magnetized to have two poles (an S pole and an N pole) in a radial direction.

As a magnet for constituting the rotor magnet 431, for example, a permanent magnet such as a rare-earth magnet (for example, a samarium-cobalt magnet) can be suitably used. However, the type of a magnet for constituting the rotor magnet 431 is not limited thereto.

At the center of the circular shape of the rotor magnet 431, a rotor shaft 432 is provided.

As shown in FIGS. 3B and 3C, one end side of the rotor shaft 432 is disposed inside a bearing 211 formed on the main plate 21, such that the rotor shaft is rotatable. Further, the other end side of the rotor shaft 432 is disposed inside a bearing 221 formed in a bearing member 22 such that the rotor shaft is rotatable.

The rotor 43 is stored in the receiving part 411 of the stator 41 (to be described below), such that the rotor can rotate around the rotor shaft 432. In the present embodiment, the rotor 43 can rotate in the receiving part 411 by a predetermined step angle if a drive pulse is applied to the coil 42.

On the rotor shaft 432, a rotor pinion 433 is provided. The rotor pinion 433 is connected to a component such as a gear (not shown) constituting a gear train mechanism for moving a hand 17 of the timepiece 100. Therefore, if the rotor 43 rotates, the component, such as a gear, engaged with the rotor pinion 433 rotates.

As shown in FIG. 2, in the present embodiment, with respect to all of the plurality of motors 4 (that is, the motors 4*a* to 4*f*), individual antimagnetic plates 5 are disposed, respectively.

Each individual antimagnetic plate 5 has a belt-like member configured to have a width equal to or greater than the diameter of the rotor magnet 431 of a corresponding motor 4 and cover a portion of the motor 4 including the rotor magnet 431.

Specifically, as shown in FIG. 3A, each individual antimagnetic plate 5 of the present embodiment has a first antimagnetic portion 51 which is a belt-like portion configured to extend in the longitudinal direction of a corresponding stator 41, and a second antimagnetic portion 52 which is a belt-like portion configured to extend in a direction perpendicular to the first antimagnetic portion 51 (that is, a direction perpendicular to the longitudinal direction of the stator 41).

The first antimagnetic portion 51 has the width equal to or greater than the diameter of the rotor magnet 431. Further, the first antimagnetic portion 51 is formed such that the length of the first antimagnetic portion in the extension direction is longer than the length of the stator 41 in the longitudinal direction. Also, the second antimagnetic portion 52 has the width equal to or greater than the diameter of the rotor magnet 431. Further, the second antimagnetic portion 52 is formed such that the length of the second antimagnetic portion in the extension direction is longer than the length of the stator 41 of the motor 4 in a direction perpendicular to the longitudinal direction of the stator.

Here, the width equal to or greater than the diameter of the rotor magnet 431 means a width which is substantially the same as or larger than the diameter of the rotor magnet 431. In a case of setting a width larger than the diameter of the rotor magnet 431, it is possible to appropriately set a width according to the size of the motor 4, the antimagnetic property which is obtained, and so on.

It is preferable to dispose the individual antimagnetic plates 5 with slight gaps from the motors 4 such that the antimagnetic plates are not in contact with the motors 4. In the present embodiment, the individual antimagnetic plates 5 are disposed on the circuit board 23 so as to correspond the motors 4, respectively.

In other words, in the present embodiment, as shown in FIGS. 3B and 3C, the circuit board 23 is disposed above the bearing member 22 (on the upper side in FIGS. 3B and 3C). Further, the individual antimagnetic plates 5 are disposed on one surface of the circuit board 23 (in the present embodiment, the front surface of the circuit board).

However, the layout of the individual antimagnetic plates 5 is not limited to that example. For example, the individual antimagnetic plates 5 may be disposed on one surface of the main plate 21 (for example, the lower surface of the main plate 21 in FIG. 3B and the like).

The individual antimagnetic plates 5 are made of, for example, SPCC (cold-reduced carbon steel sheets and strips).

However, since the individual antimagnetic plates 5 need only to gather magnetic fields, a material for making the individual antimagnetic plates 5 is not limited to SPCC. For example, the individual antimagnetic plates may be made of permalloy or the like.

Now, the operation of the timepiece (electronic timepiece) 100 according to the present embodiment will be described with reference to FIG. 4A, FIGS. 4B to 6A, and FIGS. 6B and 7.

When the timepiece 100 is assembled, the antenna 3 and the motors 4 are disposed on the main plate 21, and the bearing member 22 is disposed on the main plate with the antenna 3 and the motors 4 interposed therebetween, and the circuit board 23 is superimposed thereon.

Subsequently, at positions on the circuit board 23 corresponding to the motors 4, the individual antimagnetic plates 5 are disposed, such that the first antimagnetic portions 51 are positioned along the longitudinal directions of the stators 41, and the second antimagnetic portions 52 are positioned along directions perpendicular to the first antimagnetic portions 51.

Then, the main plate 21 having the antenna 3 and the motors 4 disposed thereon, the bearing member 22, and the circuit board 23 having the individual antimagnetic plates 5 disposed thereon are stored in the module.

Subsequently, the module, the display unit 14 including the dial 15, and the like are stored inside the timepiece case 1, and the windshield member 11 is attached to the viewable-side opening part of the timepiece case 1, and the back lid is attached to the back-side opening part of the timepiece case.

As a result, the timepiece 100 is completed.

If an external magnetic field enters the timepiece 100, the external magnetic field acts on the motors 4, thereby influencing the operation accuracy of the motors 4. Especially, each motor 4 is easily influenced by an external magnetic field entering the motor from a direction perpendicular to the longitudinal direction of the stator 41 and an external magnetic field entering the motor from a direction along the longitudinal direction, as shown in FIG. 3A.

Figure 4A:
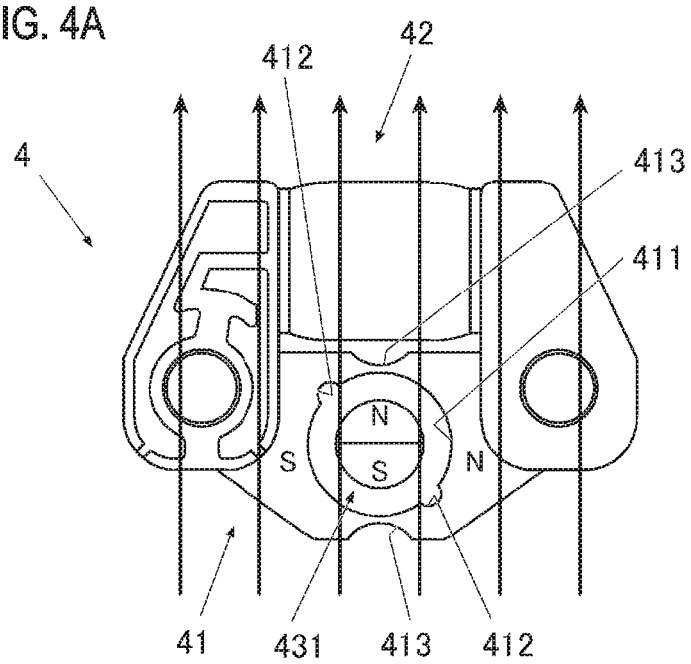
FIG. 4A is an explanatory view illustrating the flow of an external magnetic field entering a motor from a direction perpendicular to the longitudinal direction of a stator.
Figure 4B:
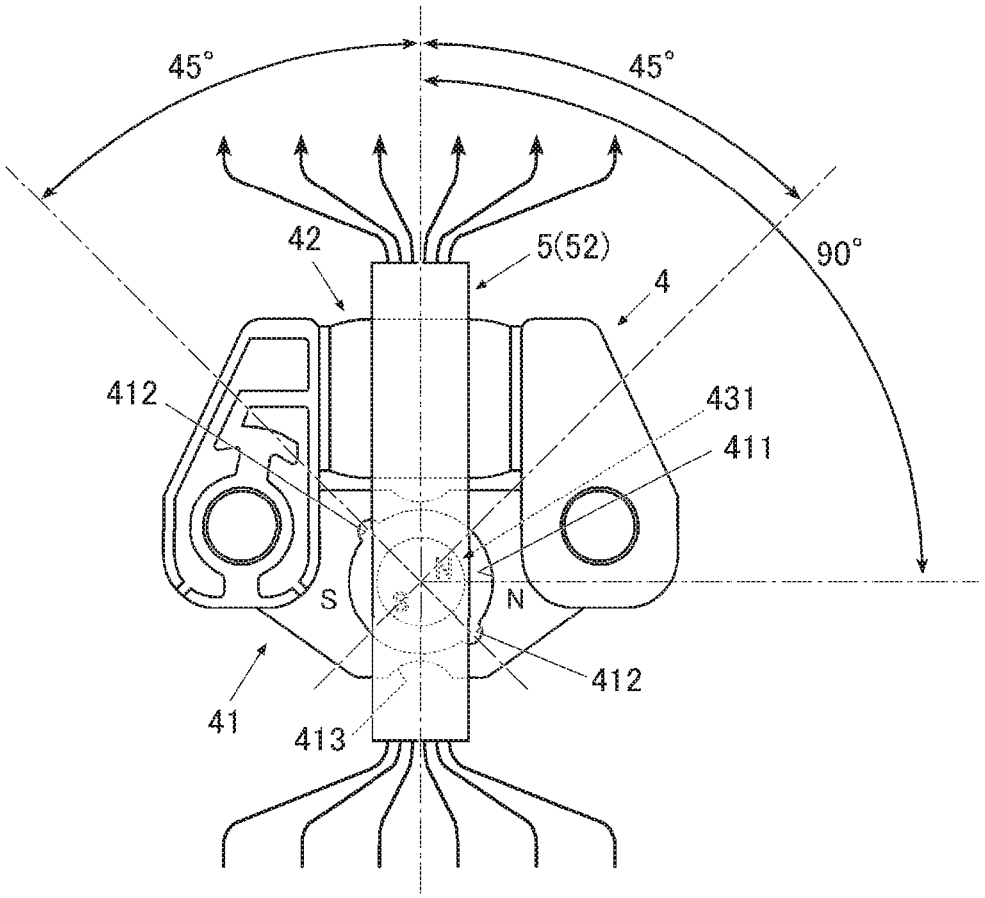
FIG. 4B is a plan view schematically illustrating a second antimagnetic portion which is disposed on a motor so as to extend in a direction perpendicular to the longitudinal direction of a stator.

First, with reference to FIGS. 4A and 4B, how a motor 4 is influenced by an external magnetic field entering the motor from a direction perpendicular to the longitudinal direction of the stator 41 will be described.

As described above, the receiving part 411 has one pair of inner recesses 412 as positioning parts for determining a position for the rotor 43 to stably stop. The inner recesses 412 are disposed such that the line connecting the deepest parts of the inner recesses 412 and passing through the center of the circle shape of the receiving part 411 forms 45° with the line extending in the longitudinal direction of the stator 41 through the center of the circle shape of the receiving part 411. Therefore, normally, in a power cutoff state, the rotor 43 magnetically stably stops such that the polarization position of the rotor magnet 431 faces the inner recesses 412. Thereafter, if a drive pulse is applied to the coil 42, this state becomes an initial state, and drive control is performed such that the rotor 43 rotates.

However, in a case where an external magnetic field passes through the motor in a direction perpendicular to the longitudinal direction of the stator 41, the upstream side of the flow of the external magnetic field becomes an N pole, and the downstream side becomes an S pole. As shown in FIG. 4A, the rotor magnet 431 is drawn to the poles generated by the flow of the external magnetic field, whereby the S pole of the rotor magnet 431 moves toward the N pole generated by the external magnetic field and the N pole of the rotor magnet 431 moves toward the S pole generated by the external magnetic field. As a result, the rotor magnet is deviated from the original stop position. In this state, if a drive pulse is applied to the coil 42, the operation of the rotor 43 becomes instable, resulting in a failure in rotation.

However, the direction of the external magnetic field which causes the above described state is not strictly limited to a direction perpendicular to the longitudinal direction of the stator 41. In a case where an external magnetic field passes through the motor while forming an angular range between −45° and 45° with a line extending at 90° with respect to the line extending in the longitudinal direction of the stator 41 through the center of the circle shape of the receiving part 411 as shown in FIG. 4B, it is apprehended that the above described situation will occur.

Also, as described above, the positions to form the inner recesses 412 for determining the stop position of the rotor 43 are determined such that the line connecting the deepest parts of the inner recesses 412 and passing through the center of the circle shape of the receiving part 411 forms a predetermined angle with the line extending in the longitudinal direction of the stator 41 through the center of the circle shape of the receiving part 411. However, the positions of the inner recesses are not strictly limited to the case where both lines form 45°, and have a slight tolerance. However, even in a case where the positions of the inner recesses 412 are slightly shift, in a case where an external magnetic field passes through the motor while forming an angular range between −45° and 45° with the line extending at 90° with respect to the line extending in the longitudinal direction of the stator 41 through the center of the circle shape of the receiving part 411, it is apprehended that the above described situation will occur.

In this regard, each individual antimagnetic plate 5 of the present embodiment has the second antimagnetic portion 52 configured to extend in a direction perpendicular to the longitudinal directions of the stator 41. Therefore, an external magnetic field flowing into the motor from a direction perpendicular to the longitudinal direction of the stator 41 (that is, a direction forming 90° with the line extending in the longitudinal direction of the stator 41 through the center of the circle shape of the receiving part 411), or from a range between −45° and 45° with respect to the corresponding direction is guided to the second antimagnetic portion 52, and flows along the second antimagnetic portion 52 without acting on the motor 4.

Especially, in the present embodiment, the second antimagnetic portion 52 is formed to be longer than the length of the stator 41 of the motor 4 in a direction perpendicular to the longitudinal direction of the stator. Therefore, as shown in FIG. 4B, the external magnetic field flowing into the second antimagnetic portion 52 passes through the second antimagnetic portion 52, and then gets out of the motor 4. Therefore, the external magnetic field rarely exerts influence on the motor 4. As a result, the rotor 43 does not move from the original stop position (the position determined such that the polarization position of the rotor magnet 431 faces the inner recesses 412), and it is possible to prevent the operation of the rotor 43 from becoming instable.

Now, with reference to FIGS. 5A and 5B, the influence of an external magnetic field which enters a motor from a direction along the longitudinal direction of the stator 41 will be described.

Figure 5A:
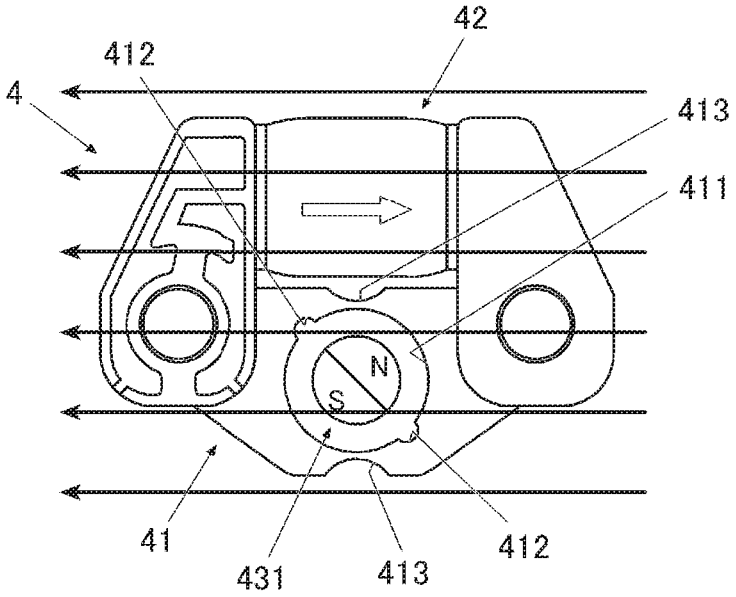
FIG. 5A is an explanatory view illustrating the flow of an external magnetic field entering a motor from the longitudinal direction of a stator.
Figure 5B:
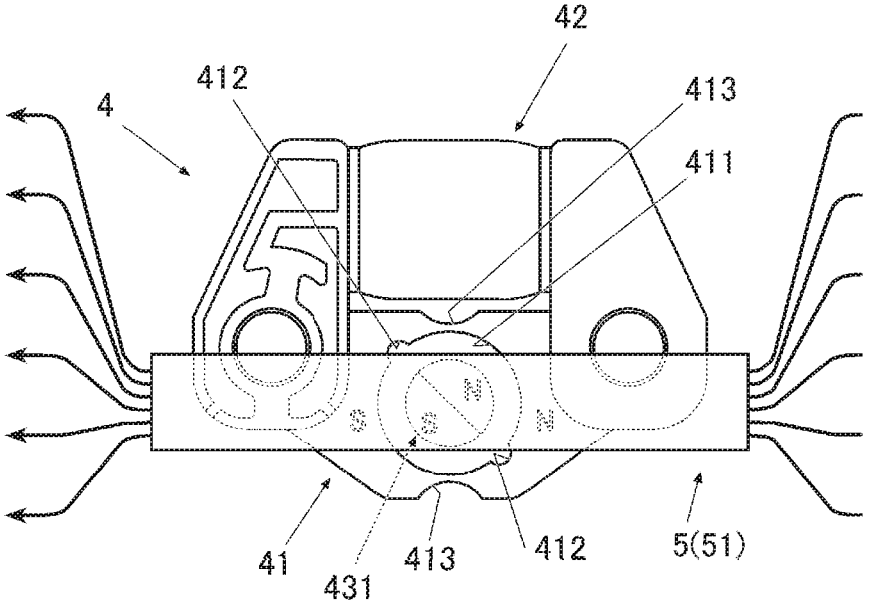
FIG. 5B is a plan view schematically illustrating a first antimagnetic portion which is disposed on a motor so as to extend in the longitudinal direction of a stator.

For example, it is assumed a case where a drive pulse has been applied to the coil 42, whereby magnetic fluxes have been generated in a direction shown by an outlined arrow in FIG. 5A, and an external magnetic field enters the motor 4 along the longitudinal direction of the stator 41 from a direction opposite to the flow of the magnetic fluxes generated by the coil 42, as shown by solid lines in FIG. 5A. In this case, the magnetic fluxes generated by the coil 42 and the external magnetic field nullify each other, whereby a case where the motor 4 cannot exert its intrinsic performance occurs.

In this regard, the individual antimagnetic plates 5 of the present embodiment each have the first antimagnetic portion 51 configured to extend in the longitudinal direction of the stator 41. Therefore, the external magnetic field flowing into the motor along the longitudinal direction of the stator 41 is guided to the first antimagnetic portion 51, and flows through the first antimagnetic portion 51 without acting on the motor 4.

Especially, in the present embodiment, the first antimagnetic portion 51 is formed to be longer than the length of the stator 41 of the motor 4 in the longitudinal direction of the stator. Therefore, as shown in FIG. 5B, the external magnetic field flowing into the first antimagnetic portion 51 passes through the first antimagnetic portion 51, and then gets out of the motor 4. Therefore, the external magnetic field rarely exerts influence on the motor 4. As a result, it is possible to prevent the external magnetic field from acting in such a direction that it nullifies the magnetic fluxes generated by the coil 42.

Figure 6A:
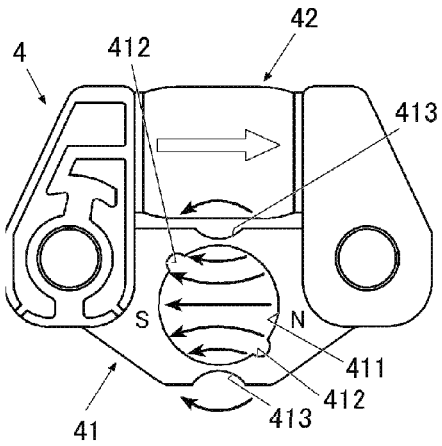
FIG. 6A is an explanatory view illustrating the flows of magnetic fluxes generated in a motor.

Also, in a case where a drive pulse is applied to the coil 42, whereby magnetic fluxes are generated in a direction shown by an outlined arrow in FIG. 6A, as described above, the magnetic fluxes flow in the stator 41 magnetically connected to the coil 42, whereby magnetic flux saturation occurs in the saturable parts between the outer recesses 413 and the receiving part 411 (the narrow parts of the stator 41). If this magnetic flux saturation occurs, the flows of magnetic field lines as shown by solid lines in FIG. 6A are generated, whereby the stator 41 is polarized to have an N pole and an S pole.

Figure 6B:
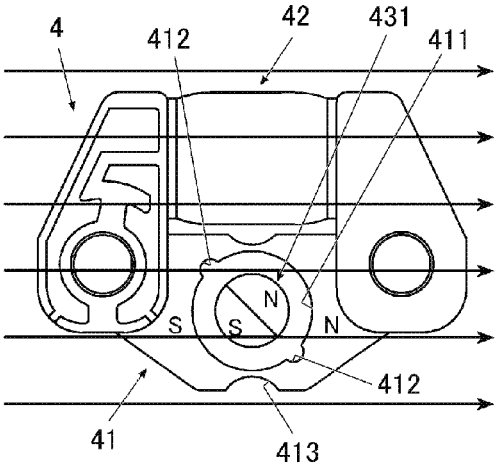
FIG. 6B is an explanatory view illustrating the flow of an external magnetic field entering a motor from a direction to nullify the flows of the magnetic fluxes shown in FIG. 6A.

In this case, if an external magnetic field acts from a direction as shown by solid lines in FIG. 6B such that the flows of the magnetic field lines are nullified, the external magnetic field may negatively affect the performance of the motor 4.

In this regard, in a case where the individual antimagnetic plate 5 has the first antimagnetic portion 51 configured to extend in the longitudinal direction of the stator 41 like in the present embodiment, the external magnetic field entering the motor from such a direction that it can nullify the flows of the magnetic field lines is guided to the first antimagnetic portion 51, and passes through the first antimagnetic portion 51, without acting on the motor 4. Therefore, it is possible to prevent the flows of the magnetic field lines from being nullified by the external magnetic field.

Figure 7:
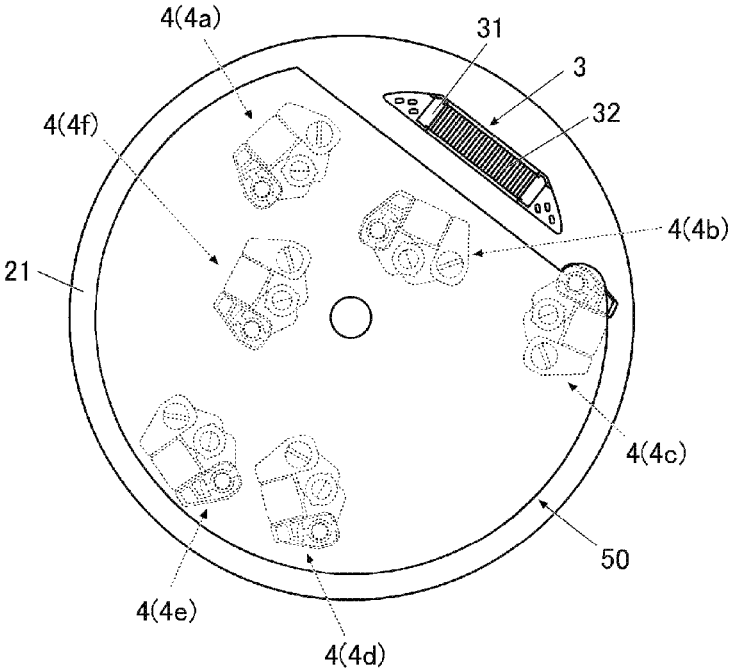
FIG. 7 RELATED ART
FIG. 7 is a plan view illustrating an antenna and motors disposed on a main plate according to an example of the related art.

FIG. 7 is a plan view illustrating the relation between the position of an antimagnetic plate and the positions of an antenna and motors in a timepiece according to the related art.

As shown in FIG. 7, in the related art, an antimagnetic plate 50 for covering almost all of motors 4 provided on a main plate 21 is provided, whereby the influence of an external magnetic field on the motors 4 (4*a* to 4*f*) is suppressed, and the antimagnetic property is improved.

However, in a case of disposing the antimagnetic plate 50 so as to cover all motors 4 as described above, a portion of the antimagnetic plate 50 is disposed at a position close to the antenna 3.

Since the antimagnetic plate 50 is a member made of a high relative-permeability material, if the antimagnetic plate 50 is in the vicinity of the antenna 3 when the antenna 3 receives a radio wave, magnetic fluxes easily pass through the antimagnetic plate 50.

If magnetic fluxes pass through the antimagnetic plate 50, eddy current occurs, and loss of electric energy (eddy-current loss) occurs, whereby the receiving sensitivity of the antenna 3 decreases.

In order to prevent such eddy current from occurring, it is preferable to dispose the antimagnetic plate 50 as far away from the antenna 3 as possible. However, in this case, motors 4 also cannot be disposed near the antenna 3. Therefore, in a case where a plurality of motors 4 should be mounted, the layout of the motors is limited.

Also, if all of the motors 4 including the coils 42 are covered with the antimagnetic plate 50, some of magnetic fluxes generated by the motors 4 are absorbed by the antimagnetic plate 50, whereby the performance of the motors 4 may deteriorate.

In this regard, in the timepiece 100 of the present embodiment, the minimal individual antimagnetic plates 5 capable of excluding external magnetic fields which may exert negative influence on the motors 4 are provided for the motors 4, respectively. Therefore, even though the motors 4 are disposed near the antenna 3, the influence of the individual antimagnetic plates 5 on the antenna 3 is less, and occurrence of eddy current attributable to the individual antimagnetic plates 5 is suppressed, and it is possible to maintain good receiving sensitivity of the antenna 3.

Also, the second antimagnetic portion 52 of each individual antimagnetic plate 5 is disposed so as to cover a portion of the coil 42 of a corresponding motor 4. Unlike a case where all motors 4 are covered with the antimagnetic plate 50 like in the related art, since each second antimagnetic portion 52 is disposed so as to extend in a direction perpendicular to the longitudinal direction of a corresponding stator 41 which is the direction of the flow of magnetic fluxes generated by a corresponding motor 4, it is difficult for the second antimagnetic portion 52 to influence the magnetic fluxes generated by the motor 4, and it is possible to improve the antimagnetic property without lowering the performance of the motor 4.

As described above, according to the present embodiment, a belt-like individual antimagnetic plate 5 having a width equal to or greater than the diameter of the rotor magnet 431 of a corresponding motor 4 is disposed so as to cover a portion of the motor 4.

Therefore, the motors 4 are magnetically shielded by the individual antimagnetic plates 5, whereby it becomes difficult for an external magnetic field which may influence the operations of the motors 4 to reach the motors 4. Therefore, problems such as malfunction of the motors 4 are prevented, and the operation accuracy is improved, and it is possible to satisfy high antimagnetic property standards as required, for example, for antimagnetic timepieces, in JIS (Japanese Industrial Standards).

In other words, it is possible to improve the antimagnetic properties of the motors 4 by preventing an external magnetic field from acting on the rotor magnets 431 most likely to be adversely influenced by the external magnetic field.

Therefore, even in a case where the motors 4 having the individual antimagnetic plates 5 are disposed near the antenna 3, since the individual antimagnetic plates 5 are small, occurrence of eddy current is less as compared to the case of providing the antimagnetic plate 50 to cover all motors 4, and it is possible to maintain good receiving sensitivity of the antenna 3.

Also, in case of the planar antimagnetic plate as shown in FIG. 7, an external magnetic field gathered by the antimagnetic plate freely flows on the planar surface without any specific restriction on the direction of the flow of the external magnetic field. In this regard, each individual antimagnetic plate 5 of the present invention is composed of a belt-like first antimagnetic portion 51 and a belt-like second antimagnetic portion 52. As described above, in a case where a portion gathering an external magnetic field has an elongated belt shape, the gathered external magnetic field is directed toward one side so as to flow along the longitudinal direction of the antimagnetic plate (that is, the first antimagnetic portion 51 and the second antimagnetic portion 52). Therefore, it is possible to more effectively and quickly release the external magnetic field to the outside of the motor 4.

Also, as described above, especially, as shown in FIG. 3A, each motor 4 is likely to be influenced by an external magnetic field entering the motor from the longitudinal direction of the stator 41 and an external magnetic field entering the motor from a direction perpendicular to the longitudinal direction of the stator 41. In this regard, the individual antimagnetic plates 5 of the present embodiment each have the first antimagnetic portion 51 configured to extend in the longitudinal direction of a corresponding stator 41, and the second antimagnetic portion 52 configured to extend in a direction perpendicular to the first antimagnetic portion 51. Therefore, it is possible to absorb an external magnetic field entering the motor from the longitudinal direction of the stator 41 by the first antimagnetic portion 51, and absorb an external magnetic field entering the motor from a direction perpendicular to the longitudinal direction of the stator 41 by the second antimagnetic portion 52, and it is possible to effectively reduce the influence of an external magnetic field entering the motor from in such a direction that the motor 4 is likely to be influenced.

Further, the first antimagnetic portion 51 is formed such that the length of the first antimagnetic portion in the extension direction is longer than the length of the stator 41 of the motor 4 in the longitudinal direction of the stator, and the second antimagnetic portion 52 is formed such that the length of the second antimagnetic portion in the extension direction is longer than the length of the stator 41 of the motor 4 in a direction perpendicular to the longitudinal direction of the stator. Therefore, it is possible to more effectively release an external magnetic field gathered by the individual antimagnetic plate 5 to the outside of the motor 4.

Also, since the individual antimagnetic plate 5 is small, as compared to a case of providing an antimagnetic plate to cover all motors like in the related art, it is possible to reduce the weight of the whole product while improving the antimagnetic properties of the motors. Further, as compared to the antimagnetic plate for covering all motors, it is possible to make the individual antimagnetic plates 5 with a smaller amount of material, and it is possible to reduce the cost of the timepiece.

Also, since the present embodiment is used in the timepiece (electronic timepiece) 100 which has the antenna 3 for receiving radio waves and where the individual operation units are driven by the motors 4, it is possible to secure the radio-wave receiving sensitivity of the antenna 3 while securing the operation accuracy of the motors 4. Therefore, it is possible to implement the timepiece 100 capable of accurate time adjustment based on a standard radio wave, without sacrificing the antimagnetic property.

Also, since the present embodiment is used, the degree of freedom of the arrangement relation between the antenna 3 and the motors 4 is improved, whereby it is possible to expect an effect that the degree of freedom of product design increases.

Also, in the present embodiment, a case where each of the individual antimagnetic plates 5 is one member in which the first antimagnetic portion 51 which is a belt-like portion configured to extend in the longitudinal direction of a corresponding stator 41 and the second antimagnetic portion 52 which is a belt-like portion configured to extend in a direction perpendicular to the first antimagnetic portion 51 are connected has been described as an example. However, the first antimagnetic portion 51 configured to extend in the longitudinal direction of the stator 41 and the second antimagnetic portion 52 configured to extend in a direction perpendicular to the first antimagnetic portion 51 may be separate members.

For example, if the first antimagnetic portions 51 and the second antimagnetic portions 52 are belt-like members having the same shape, and the individual antimagnetic plates 5 are configured by manufacturing a plurality of belt-like members and combining and disposing the belt-like members in a cross shape, it is possible to easily make the individual antimagnetic plates 5 at a low cost.

Also, in a case where each of the individual antimagnetic plates 5 has the first antimagnetic portion configured to extend in the longitudinal direction of a corresponding stator 41 and the second antimagnetic portion configured to extend in a direction perpendicular to the first antimagnetic portion, if the first antimagnetic portion 51 and the second antimagnetic portion 52 are separate members, one may be disposed on the front side of a corresponding motor 4 and the other may be disposed on the back side of the motor 4.

Figure 8C:
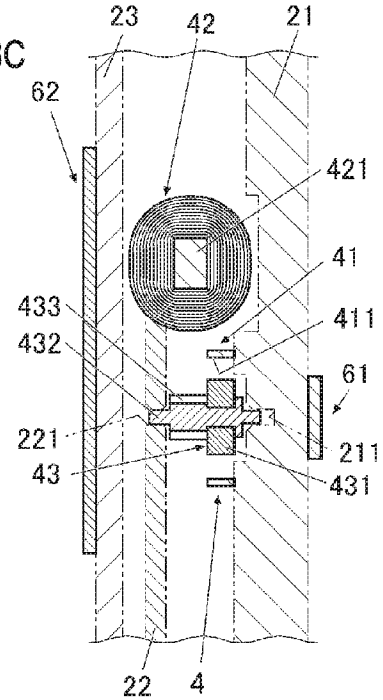
FIG. 8C is a cross-sectional view of a main portion along a line c-c of FIG. 8A.
Figure 8A:
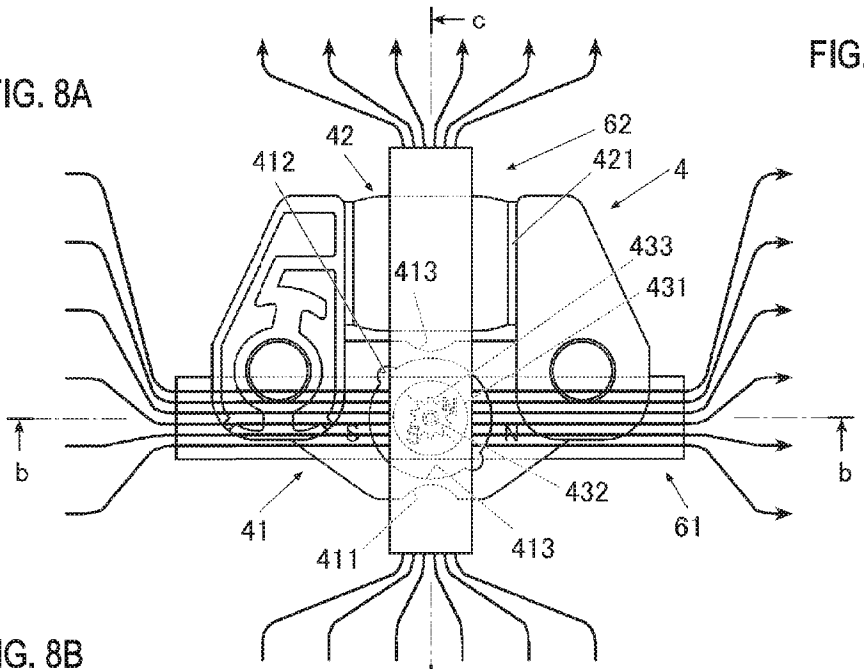
FIG. 8A is a plan view illustrating motors and individual antimagnetic plates according to a modification of the first embodiment.
Figure 8B:
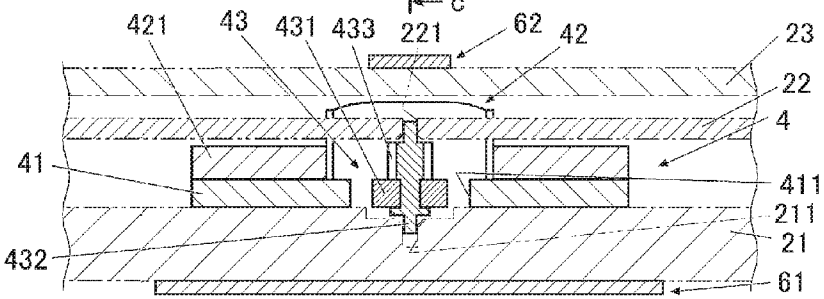
FIG. 8B is a cross-sectional view of a main portion along a line b-b of FIG. 8A.

For example, in FIGS. 8A to 8C, a case of disposing the first antimagnetic portion 61 on the back side of the main plate 21 (the lower surface side in FIG. 8B) and disposing the second antimagnetic portion 62 on the front side of the circuit board 23 (the upper surface side in FIG. 8B) is shown as an example. However, the layout of the first antimagnetic portion 61 and the second antimagnetic portion 62 is not limited to the example shown in FIG. 8B.

Also, in the present embodiment, a case where the individual antimagnetic plates 5 are disposed on the front surface of the circuit board 23 (the upper surface in FIG. 3B) has been described as an example. However, positions where the individual antimagnetic plates 5 are provided are not limited thereto.

For example, the antimagnetic plates may be disposed on the back surface of the circuit board 23 (the lower surface in FIG. 3B), or may be disposed on the front surface of the bearing member 22 (the upper surface in FIG. 3B), the back surface of the main plate 21 (the lower surface in FIG. 3B), or the like.

Also, the individual antimagnetic plates 5 may be disposed on the front and back of each of the motors 4 (the upper and lower surfaces in FIG. 3B) such that the motors 4 are interposed between the individual antimagnetic plates 5. In this case, it is possible to expect an effect that an external magnetic field is more effectively gathered and the antimagnetic properties of the motors 4 are improved.

Also, in this case, the individual antimagnetic plates 5 which are disposed on the front and back of each motor 4 (the upper and lower surfaces in FIG. 3B) may be identical to each other, or may have different shapes. For example, on the front side of a motor 4 (the upper side in FIG. 3B), an almost cross-shaped individual antimagnetic plate 5 having a first antimagnetic portion 51 and a second antimagnetic portion 52 may be disposed, and on the back side of the motor 4 (the lower side in FIG. 3B), an individual antimagnetic plate similar to a belt-like first antimagnetic portion 51 or second antimagnetic portion 52 may be disposed.

Also, in the present embodiment, a case where each individual antimagnetic plate 5 is an almost cross-shaped plate having both of a first antimagnetic portion 51 configured to extend in the longitudinal direction of a corresponding stator 41 and a second antimagnetic portion 52 configured to extend in a direction perpendicular to the first antimagnetic portion 51 has been described as an example. However, the shape of the individual antimagnetic plates is not limited to the cross shape.

Figure 9:
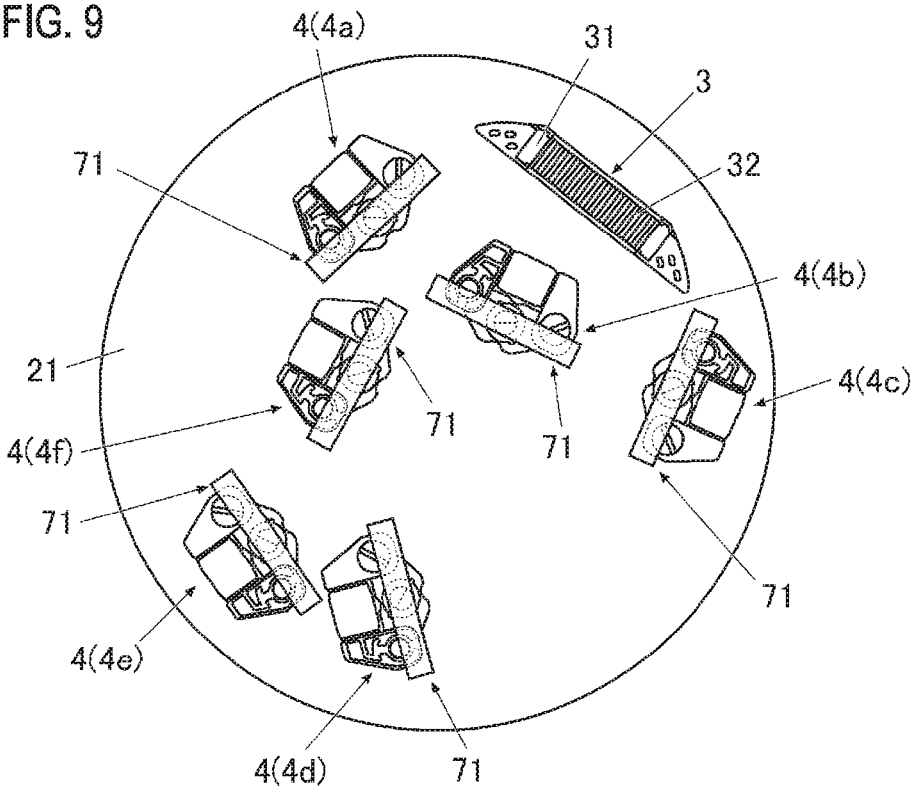
FIG. 9 is a plan view illustrating an antenna and motors disposed on a main plate according to another modification of the first embodiment.
Figure 10:
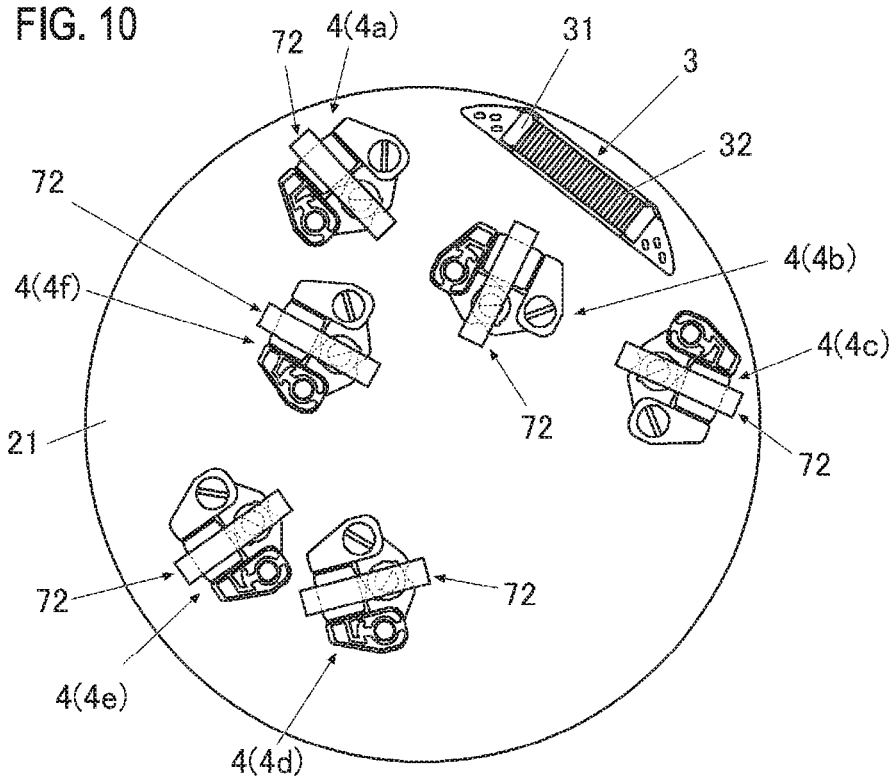
FIG. 10 is a plan view illustrating an antenna and motors disposed on a main plate according to a further modification of the first embodiment.

For example, as shown in FIG. 9, each individual antimagnetic plate may be a belt-like individual antimagnetic plate 71 composed of only a part corresponding to a first antimagnetic portion configured to extend in the longitudinal direction of a corresponding stator 41, or as shown in FIG. 10, each individual antimagnetic plate may be a belt-like individual antimagnetic plate 72 composed of only a part corresponding to a second antimagnetic portion configured to extend in a direction perpendicular to the longitudinal direction of a corresponding stator 41.

Also, even in this case, it is preferable that each belt-like individual antimagnetic plate 71 which is configured to extend in the longitudinal direction of a corresponding stator 41 should be formed such that the individual antimagnetic plate has a width equal to or greater than the diameter of the rotor magnet 431 of a corresponding motor 4 and the length of the individual antimagnetic plate in the extension direction is longer than the length of the stator 41 of the motor 4 in the longitudinal direction of the stator. Also, it is preferable that each belt-like individual antimagnetic plate 72 which is configured to extend in a direction perpendicular to the longitudinal direction of a corresponding stator 41 should be formed such that the individual antimagnetic plate has a width equal to or greater than the diameter of the rotor magnet 431 of a corresponding motor 4 and the length of the individual antimagnetic plate in the extension direction is longer than the length of the stator 41 of the motor 4 in a direction perpendicular to the longitudinal direction of the stator.

The direction of an external magnetic field to influence the operation of a motor 4, that is, the direction of an external magnetic field to more strongly influence the motor 4, thereby causing the antimagnetic property of the motor 4 to decrease depends on the size and shape of the motor 4, and both of an external magnetic field entering the motor from the longitudinal direction of the stator 41 and an external magnetic field entering the motor from a direction perpendicular to the longitudinal direction of the stator 41 do not always make the operation of the motor instable.

Therefore, according to the specifications of the motors 4, it is conceivable either to dispose the individual antimagnetic plates 71 so as to extend in the longitudinal directions of the stators 41 as shown in FIG. 9 or to dispose the individual antimagnetic plates 72 so as to extend in directions perpendicular to the longitudinal directions of the stators 41 as shown in FIG. 10, thereby sufficiently securing the antimagnetic properties of the motors 4.

In this case where only the individual antimagnetic plates 71 are disposed to extend in the longitudinal directions of the stators 41 or only the individual antimagnetic plates 72 are disposed to extend in directions perpendicular to the longitudinal directions of the stators 41, since the areas of the antimagnetic plates are small, it is possible to further reduce the influence of the individual antimagnetic plates on the antenna 3, and it is possible to reduce the weight of the timepiece. Also, it is possible to reduce the manufacturing cost (material cost) of the individual antimagnetic plates.

Also, all of the individual antimagnetic plates which are provided in the timepiece 100 do not need to have the same shape, and individual antimagnetic plates having various shapes and forms as described above (that is, the cross-shaped individual antimagnetic plates 5, the belt-like individual antimagnetic plates 71 and 72, and the like) may be appropriately used for the individual motors 4.

[Second Embodiment]

Now, a second embodiment of the electronic timepiece according to the present invention will be described with reference to FIG. 11. Since the present embodiment is different from the first embodiment only in the configuration of antimagnetic plates, particularly, the difference from the first embodiment will be described below.

Figure 11:
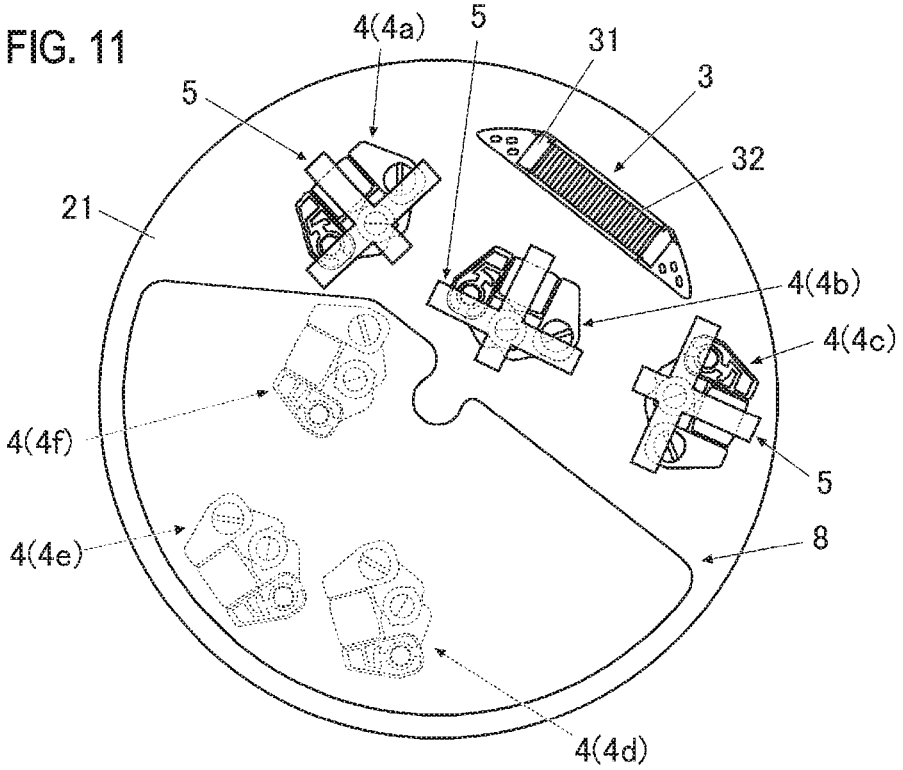
FIG. 11 is a plan view illustrating an antenna and motors disposed on a main plate according to a second embodiment.

FIG. 11 is a plan view illustrating an antenna and motors provided inside a module according to the present embodiment.

As shown in FIG. 11, in the present embodiment, similarly in the first embodiment, one antenna 3 and six motors 4 (motors 4*a* to 4*f*) are disposed on a main plate 21, which is assembled in the module.

Further, at least with respect to some (in FIG. 11, the motors 4*a* to 4*c*) of the plurality of motors 4 (in the present embodiment, the motors 4*a* to 4*f*) disposed in a predetermined range from the antenna 3, individual antimagnetic plates 5 identical to those of the first embodiment are disposed, respectively.

In other words, the individual antimagnetic plates 5 which are disposed for the motors 4*a* to 4*c* are belt-like members configured to have widths equal to or greater than the diameters of corresponding rotor magnets 431 and cover portions of the motors 4 including the rotor magnets 431.

Further, in the present embodiment, the timepiece further includes a planar antimagnetic plate 8 configured to cover some or all of the motors 4 disposed outside the predetermined range from the antenna 3. The material and the like of the planar antimagnetic plate 8 are the same as those of the individual antimagnetic plates 5, and thus will not be described.

In the present embodiment, as shown in FIG. 11, the planar antimagnetic plate 8 has a fan shape and is disposed to cover the motors 4*d* to 4*f*.

Also, the shape and size of the planar antimagnetic plate 8, the number of motors 4 which are covered by the planar antimagnetic plate 8, and the like are not particularly limited.

The planar antimagnetic plate 8 does not need to cover all of the motors 4 disposed outside the predetermined range from the antenna 3, and may be configured to cover only some of them.

Also, only one planar antimagnetic plate 8 may be provided, or two or more planar antimagnetic plates may be provided.

Here, a reference for determining whether a motor 4 is inside the predetermined range from the antenna 3 is appropriately set on the basis of the extent to which the receiving sensitivity of the antenna 3 is influenced by providing an antimagnetic plate (the planar antimagnetic plate 8) to cover the whole of the motor 4. The influence on the receiving sensitivity decreases as the antimagnetic plate (the planar antimagnetic plate 8) gets further away from the antenna 3, and specifically, it is preferable to individually determine the specific distance, arrangement relation, and the like between the antenna 3 and each motor 4 in view of the level of the receiving sensitivity of the antenna 3, the size and the like of the timepiece case 1 where the antenna 3, the motors 4, and the like are assembled, and so on.

In the present embodiment, an example in which the motors 4 directly facing the antenna 3 (in FIG. 11, the motors 4*a* to 4*c* in the first row facing the antenna 3) are in the predetermined range from the antenna 3 and the other motors 4 (in FIG. 11, the motors 4*d* to 40 are outside the predetermined range from the antenna 3 is shown.

Also, the other configuration is the same as that of the first embodiment, and thus identical members are denoted by the same reference symbols and will not be described.

Now, the operation of the timepiece (electronic timepiece) 100 according to the present embodiment will be described.

First, with respect to each of the motors 4 disposed in the predetermined range from the antenna 3 (in FIG. 11, the motors 4*a* to 4*c*), similarly in the first embodiment, an individual antimagnetic plate 5 having a belt-like first antimagnetic portion configured to extend in the longitudinal direction of the stator 41 and a belt-like second antimagnetic portion configured to extend in a direction perpendicular to the first antimagnetic portion is disposed.

Then, with respect to the motors 4 disposed outside the predetermined range from the antenna 3 (in FIG. 11, the motors 4*d* to 4*f*), the planar antimagnetic plate 8 is disposed to cover all of them.

In this case, the motors 4*d* to 4*f* are magnetically shielded from external magnetic fields by covering all of the motors 4 with the planar antimagnetic plate 8.

Also, the motors 4*a* to 4*c* disposed in the predetermined range from the antenna 3 are shielded from external magnetic fields from such directions that the magnetic fields may exert negative influence particularly on the operations of the motors 4, by efficiently gathering the external magnetic fields by the individual antimagnetic plates 5 which are relatively small in size and in which occurrence of eddy current is less. Therefore, the operation accuracy of the motors 4 is secured, without reducing the receiving sensitivity of the antenna 3.

The other points are the same as those of the first embodiment, and thus will not be described.

As described above, according to the present embodiment, in addition to the same effects as those of the first embodiment, the following effects can be obtained.

In other words, in the present embodiment, only with respect to the motors 4*a* to 4*c* disposed in the predetermined range from the antenna 3, the individual antimagnetic plate 5 are provided, and the motors 4*d* to 4*f* disposed outside the predetermined range from the antenna 3 are magnetically shielded from external magnetic fields by the planar antimagnetic plate 8.

Therefore, as compared to the case of providing the individual antimagnetic plates 5 with respect to all motors 4, the number of components is smaller, and thus it is possible to achieve a reduction in the assembly man-hours, and the like.

Even in this case, since the motors 4*a* to 4*c* disposed in the predetermined range from the antenna 3 are shielded from external magnetic fields from such direction that the magnetic fields may exert negative influence particularly on the operations of the motors 4, by efficiently gathering the external magnetic fields by the individual antimagnetic plates 5, it is possible to minimize the influence of provision of the antimagnetic plates on the antenna 3. Therefore, the operation accuracy of the motors 4 is secured, without reducing the receiving sensitivity of the antenna 3.

Also, the shapes and configurations of the individual antimagnetic plates 5 which are applied for the motors 4 disposed in the predetermined range from the antenna 3 (in FIG. 11, the motors 4*a* to 4*c*) are not limited to the example shown in FIG. 11.

For example, as described above, belt-like individual antimagnetic plates configured to extend in the longitudinal directions of the stators 41 (see the individual antimagnetic plates 71 of FIG. 9), belt-like individual antimagnetic plates configured to extend in directions perpendicular to the longitudinal directions of the stators 41 (see the individual antimagnetic plates 72 of FIG. 10), and the like can be used.

Also, all of the individual antimagnetic plates do not need to have the same shape, and individual antimagnetic plates having various shapes and forms as described above may be appropriately used for the individual motors 4.

Also, in the present embodiment, a case where the individual antimagnetic plates 5 and the planar antimagnetic plate 8 are separately and independently provided has been described as an example. However, the configuration of the antimagnetic plates is not limited thereto, and some or all of the individual antimagnetic plates may be connected to the planar antimagnetic plate.

Figure 12:
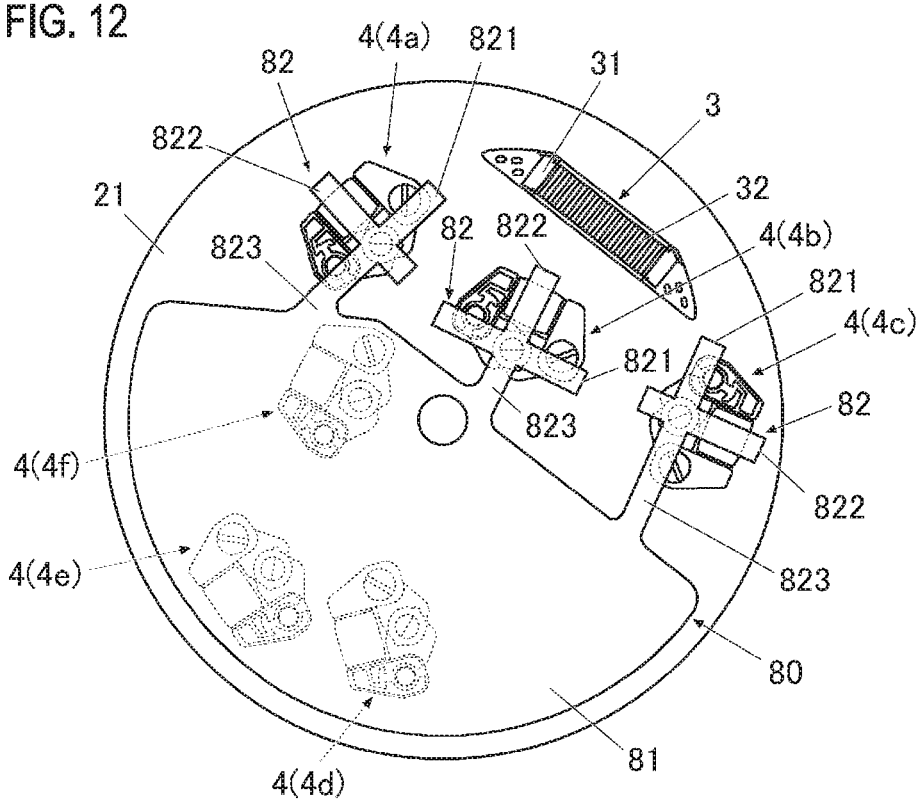
FIG. 12 is a plan view illustrating an antenna and motors disposed on a main plate according to a modification of the second embodiment.

Specifically, as shown in FIG. 12, an antimagnetic plate 80 may have a planar antimagnetic plate 81 configured to be applied for the motors 4 disposed outside the predetermined range from the antenna 3 (in FIG. 12, the motors 4*d* to 4*f*), and individual antimagnetic plates 82 configured to be applied for the motors 4 disposed in the predetermined range from the antenna 3 (in FIG. 12, the motors 4*a* to 4*c*), respectively, and be connected to the planar antimagnetic plate 81.

For example, in FIG. 12, each individual antimagnetic plate 82 having a first antimagnetic portion 821 configured to extend in the longitudinal direction of a corresponding stator 41, and a second antimagnetic portion 82 configured to extend in a direction perpendicular to the longitudinal direction of the stator 41 is connected to the planar antimagnetic plate 8 by a connection portion 823.

In this case where some or all of the individual antimagnetic plates are connected to the planar antimagnetic plate, the number of components is smaller than that in the case of individually manufacturing and assembling the antimagnetic plates. Therefore, the assembly man-hours also decrease.

Also, since portions of the individual antimagnetic plates having less influence on the antenna 3 are connected to the planar antimagnetic plate, it is possible to more effectively gather external magnetic fields, without reducing the receiving sensitivity of the antenna 3, as compared to the case of individually providing the antimagnetic plates. Therefore, the operation accuracy of the motors 4 can be expected to be more surely improved.

However, all of the individual antimagnetic plates 82 may not need to be connected to the planar antimagnetic plate 8. For example, in FIG. 12, only the individual antimagnetic plates 82 provided for the motors 4*a* and 4*b* may be connected to the planar antimagnetic plate 8 by the connection portions 823, and the individual antimagnetic plate 82 provided for the motor 4*c* may be separately and independently disposed.

Also, the individual antimagnetic plates 82 connected to the planar antimagnetic plate 8 by the connection portions 823 may be connected to each other by a connection portion.

[Third Embodiment]

Now, a third embodiment of the electronic timepiece according to the present invention will be described with reference to FIG. 13. Since the present embodiment is different from the first embodiment and the like only in the configuration of antimagnetic plates, particularly, the difference from the first embodiment and the like will be described below.

Figure 13:
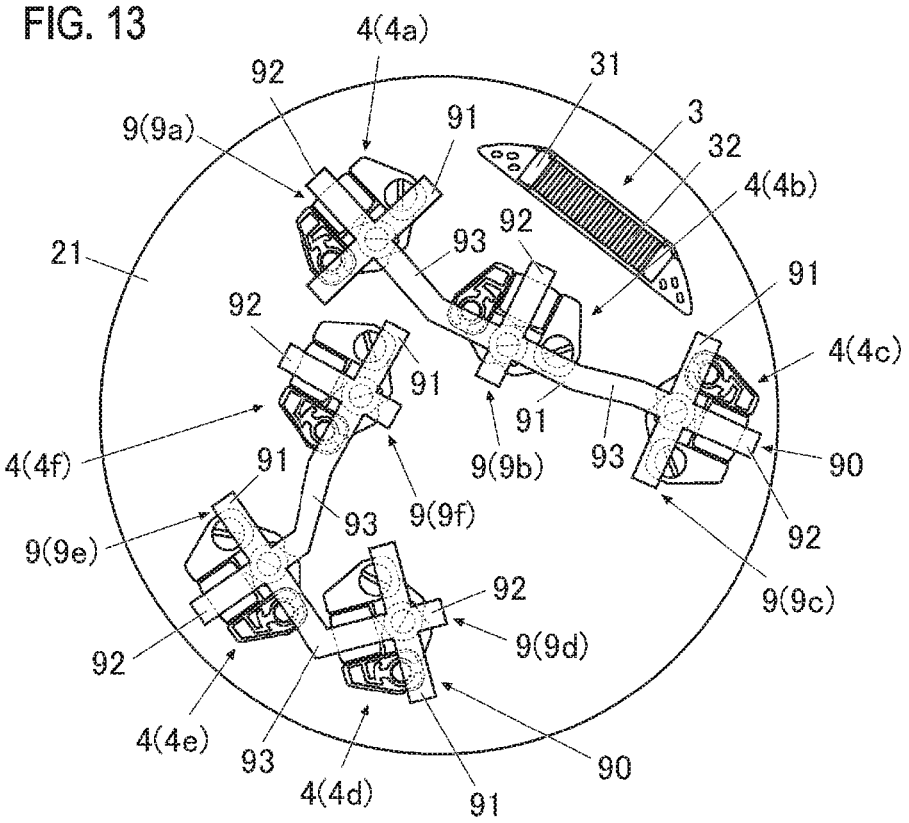
FIG. 13 is a plan view illustrating an antenna and motors disposed on a main plate according to a third embodiment.

FIG. 13 is a plan view illustrating an antenna and motors provided inside a module according to the present embodiment.

As shown in FIG. 13, in the present embodiment, similarly in the first embodiment, one antenna 3 and six motors 4 (motors 4*a* to 4*f*) are disposed on a main plate 21, which is assembled in the module.

Further, with respect to the plurality of motors 4 (in the present embodiment, the motors 4*a* to 4*f*), belt-like individual antimagnetic plates 9 (in FIG. 13, individual antimagnetic plates 9*a* to 9*f*) configured to have widths equal to or greater than the diameters of the rotor magnets 431 and cover portions of the motors 4 including the rotor magnets 431 similarly to those of the first embodiment are disposed, respectively.

Similarly in the first embodiment, each individual antimagnetic plate 9 (in FIG. 13, each of the individual antimagnetic plates 9*a* to 9*f*) has a first antimagnetic portion 91 configured to extend in the longitudinal direction of a corresponding stator 41 and a second antimagnetic portion 92 configured to extend in a direction perpendicular to the first antimagnetic portion.

Further, in the present embodiment, some or all of the individual antimagnetic plates 9 are connected by connection portions 93. Individual antimagnetic plates having longitudinal directions substantially aligned with each other are connected, whereby it is possible to improve the antimagnetic property in the connection direction.

Specifically, the individual antimagnetic plates 9*a* to 9*c* provided with respect to the motors 4*a* to 4*c* are connected by connection portions 93, thereby constituting an antimagnetic connection plate 90.

Similarly, the individual antimagnetic plates 9*d* to 9*f* provided with respect to the motors 4*d* to 4*f* are connected by connection portions 93, thereby constituting another antimagnetic connection plate 90.

In the present embodiment, a case where two antimagnetic connection plates 90 each including three individual antimagnetic plates 9 connected are provided has been described as an example. However, the configuration of the antimagnetic connection plates 90 is not limited thereto. For example, all of six individual antimagnetic plates 9*a* to 9*f* may be connected, thereby constituting one antimagnetic connection plate 90.

Also, the other configuration is the same as that of the first embodiment or the like, and thus identical members are denoted by the same reference symbols and will not be described.

Now, the operation of the timepiece (electronic timepiece) according to the present embodiment will be described.

First, with respect to the plurality of motors 4 (in FIG. 13, the motors 4*a* to 4*f*), similarly in the first embodiment, the individual antimagnetic plates 9 (in FIG. 13, the individual antimagnetic plates 9*a* to 9*f*) having the belt-like first antimagnetic portions 91 configured to extend the longitudinal directions of the stators 41 and the belt-like second antimagnetic portions 92 configured to extend in directions perpendicular to the first antimagnetic portions are disposed, respectively.

Then, as some of the individual antimagnetic plates 9 having longitudinal directions aligned with one another, the individual antimagnetic plates 9*a* to 9*c* provided with respect to the motors 4*a* to 4*c* are connected by the connection portions 93, thereby forming an antimagnetic connection plate 90. Similarly, as other antimagnetic plates having longitudinal directions aligned with one another, the individual antimagnetic plates 9*d* to 9*f* provided with respect to the motors 4*d* to 4*f* are connected by the connection portions 93, thereby forming another antimagnetic connection plate 90.

Even in this case, the motors 4*a* to 4*f* are shielded from external magnetic fields from such directions that the magnetic fields may exert negative influence particularly on the operations of the motors 4, by efficiently gathering the external magnetic fields by the individual antimagnetic plates 9*a* to 9*f* which are relatively small in size and in which occurrence of eddy current is less. Therefore, the operation accuracy of the motors 4 is secured, without reducing the receiving sensitivity of the antenna 3.

Further, since the individual antimagnetic plates 9*a* to 9*c* are connected by the connection portions 93, thereby constituting an antimagnetic connection plate 90, and the individual antimagnetic plates 9*d* to 9*f* are connected by the connection portions 93, thereby constituting another antimagnetic connection plate 90, in the connection directions, it is possible to expect higher magnetism gathering effect and an improvement in the antimagnetic property.

The other points are the same as those of the first embodiment or the like, and thus will not be described.

As described above, according to the present embodiment, in addition to the same effects as those of the first embodiment, the following effects can be obtained.

In other words, in the present embodiment, the individual antimagnetic plates 9*a* to 9*c* are connected by the connection portions 93, thereby constituting an antimagnetic connection plate 90, and the individual antimagnetic plates 9*d* to 9*f* are connected by the connection portions 93, thereby constituting another antimagnetic connection plate 90. Therefore, in the connection directions, it is possible to expect higher magnetism gathering effect and an improvement in the antimagnetic property, as compared to the case using the separate individual antimagnetic plates 9*a* to 9*f*.

Also, since some or all of the individual antimagnetic plates 9 are connected into one member, the number of components is less than that in the case of separately and independently providing the individual antimagnetic plates 5 with respect to all motors 4. Therefore, it is possible to achieve a reduction in the assembly man-hours, and the like.

Although the embodiments of the present invention have been described above, the present invention is not limited to those embodiments, and it goes without saying that various modifications are possible without departing from the scope of the present invention.

For example, in each embodiment, the layout of the individual antimagnetic plates has been described with reference to a case where it is necessary to dispose the antimagnetic plates near the antenna 3. However, a situation in which the individual antimagnetic plates are disposed is not limited to the case of disposing the antimagnetic plates near the antenna 3.

For example, components (such as a magnetic sensor) may be influenced by antimagnetic plate if the antimagnetic plates are disposed near the components. In a case of mounting such components, if the individual antimagnetic plates shown in the embodiments are applied, it is possible to secure the accuracy of the components while improving their antimagnetic properties.

Although some embodiments of the present invention have been described, the scope of the present invention is not limited to the above described embodiments, and includes the scopes of inventions disclosed in claims and the scopes of their equivalents.

What is claimed is:

1. An electronic timepiece comprising:

an antenna;

a motor including a stator, a coil magnetically connected to the stator, and a rotor magnet disposed in a receiving part of the stator; and a belt-like antimagnetic plate configured to have a width equal to or greater than a diameter of the rotor magnet and to cover a portion of the motor including the rotor magnet, wherein the antimagnetic plate includes a first antimagnetic portion that is a belt-like portion configured to extend in a longitudinal direction of the stator and a second antimagnetic portion that is a belt-like portion configured to extend in a direction perpendicular to the first antimagnetic portion.

2. The electronic timepiece according to claim 1, wherein:

a length of the first antimagnetic portion of the antimagnetic plate is longer than a length of the stator in the longitudinal direction of the stator.

3. The electronic timepiece according to claim 1, wherein:

the second antimagnetic portion of the antimagnetic plate extends in a direction perpendicular to a longitudinal direction of the stator, and a length of the second antimagnetic portion is longer than a length of the stator in the direction perpendicular to the longitudinal direction of the stator.

4. The electronic timepiece according to claim 1, wherein:

a length of the first antimagnetic portion in the extension direction is longer than a length of the stator in the longitudinal direction of the stator, and a length of the second antimagnetic portion in the extension direction is longer than a length of the stator in a direction perpendicular to the longitudinal direction of the stator.

5. The electronic timepiece according to claim 1, wherein:

a plurality of the motors is disposed, a plurality of the antimagnetic plates is disposed so that each of the antimagnetic plates is arranged for a corresponding one of the motors, and some or all of the antimagnetic plates are connected by a connection portion.

6. The electronic timepiece according to claim 2, wherein:

a plurality of the motors is disposed, a plurality of the antimagnetic plates is disposed so that each of the antimagnetic plates is arranged for a corresponding one of the motors, and some or all of the antimagnetic plates are connected by a connection portion.

7. The electronic timepiece according to claim 3, wherein:

a plurality of the motors is disposed, a plurality of the antimagnetic plates is disposed so that each of the antimagnetic plates is arranged for a corresponding one of the motors, and some or all of the antimagnetic plates are connected by a connection portion.

8. The electronic timepiece according to claim 4, wherein:

a plurality of the motors is disposed, a plurality of the antimagnetic plates is disposed so that each of the antimagnetic plates is arranged for a corresponding one of the motors, and some or all of the antimagnetic plates are connected by a connection portion.

9. The electronic timepiece according to claim 1, wherein:

a plurality of the motors is disposed, and at least one belt-like antimagnetic plate is disposed for a corresponding at least one motor disposed in a predetermined range from the antenna, and the electronic timepiece further comprises:

a planar antimagnetic plate configured to cover some or all of the motors disposed outside the predetermined range from the antenna.

10. The electronic timepiece according to claim 2, wherein:

a plurality of the motors is disposed, and at least one belt-like antimagnetic plate is disposed for a corresponding at least one motor disposed in a predetermined range from the antenna, and the electronic timepiece further comprises:

a planar antimagnetic plate configured to cover some or all of the motors disposed outside the predetermined range from the antenna.

11. The electronic timepiece according to claim 3, wherein:

a plurality of the motors is disposed, and at least one belt-like antimagnetic plate is disposed for a corresponding at least one motor disposed in a predetermined range from the antenna, and the electronic timepiece further comprises:

a planar antimagnetic plate configured to cover some or all of the motors disposed outside the predetermined range from the antenna.

12. The electronic timepiece according to claim 4, wherein:

a plurality of the motors is disposed, and at least one belt-like antimagnetic plate is disposed for a corresponding at least one motor disposed in a predetermined range from the antenna, and the electronic timepiece further comprises:

a planar antimagnetic plate configured to cover some or all of the motors disposed outside the predetermined range from the antenna.

13. The electronic timepiece according to claim 9, wherein:

a plurality of the belt-like antimagnetic plates is disposed so that each of the belt-like antimagnetic plates is arranged for a corresponding one of the motors disposed in the predetermined range from the antenna, and some or all of the belt-like antimagnetic plates are connected to the planar antimagnetic plate by connection portions.

14. The electronic timepiece according to claim 10, wherein:

a plurality of the belt-like antimagnetic plates is disposed so that each of the belt-like antimagnetic plates is arranged for a corresponding one of the motors disposed in the predetermined range from the antenna, and some or all of the belt-like antimagnetic plates are connected to the planar antimagnetic plate by connection portions.

15. The electronic timepiece according to claim 11, wherein:

a plurality of the belt-like antimagnetic plates is disposed so that each of the belt-like antimagnetic plates is arranged for a corresponding one of the motors disposed in the predetermined range from the antenna, and some or all of the belt-like antimagnetic plates are connected to the planar antimagnetic plate by connection portions.

16. The electronic timepiece according to claim 12, wherein:

a plurality of the belt-like antimagnetic plates is disposed so that each of the belt-like antimagnetic plates is arranged for a corresponding one of the motors disposed in the predetermined range from the antenna, and some or all of the belt-like antimagnetic plates are connected to the planar antimagnetic plate by connection portions.

* * * * *